US010047606B2

(12) United States Patent
Wetch et al.

(10) Patent No.: US 10,047,606 B2
(45) Date of Patent: Aug. 14, 2018

(54) VANE PUMP

(71) Applicant: Hamilton Sundstrand Corporation, Charlotte, NC (US)

(72) Inventors: Joseph Wetch, Roscoe, IL (US); Weishun Ni, Rockton, IL (US); Edward W. Goy, Crystal Lake, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 146 days.

(21) Appl. No.: 14/804,969

(22) Filed: Jul. 21, 2015

(65) Prior Publication Data

US 2017/0022813 A1 Jan. 26, 2017

(51) Int. Cl.

| | |
|---|---|
| ***F01C 21/08*** | (2006.01) |
| ***F04C 2/34*** | (2006.01) |
| ***F04C 18/24*** | (2006.01) |
| ***F04C 2/344*** | (2006.01) |

(52) U.S. Cl.

CPC ..... *F01C 21/0836* (2013.01); *F01C 21/0863* (2013.01); *F04C 2/3446* (2013.01); *F04C 18/24* (2013.01)

(58) Field of Classification Search

CPC ..... F01C 21/0872; F01C 21/0845; F01C 21/0863; F01C 21/0809; F04C 23/001

USPC ..... 418/243, 244, 256, 266–268

See application file for complete search history.

(56) References Cited

U.S. PATENT DOCUMENTS 3,221,665 A 12/1965 Hartmann
3,869,231 A * 3/1975 Adams ..... F01C 1/3446 418/267
3,981,647 A * 9/1976 Schoeps ..... F01C 21/0809 418/241
3,981,648 A * 9/1976 Jordan ..... F01C 21/0863 418/267
4,274,816 A 6/1981 Kobayashi et al.
5,163,825 A * 11/1992 Oetting ..... F01C 1/44 418/153
5,733,109 A * 3/1998 Sundberg ..... F01C 21/0863 418/268
7,637,724 B2 * 12/2009 Cygnor ..... F01C 21/0863 418/268
7,707,987 B2 * 5/2010 Guthrie ..... F01C 1/3446 123/227
8,360,759 B2 * 1/2013 Pekrul ..... F01C 1/3445 418/184
2014/0271310 A1 9/2014 Whitesel

OTHER PUBLICATIONS

Search Report regarding related EP App. No. 16180630.2; dated Sep. 13, 2016; 7 pgs.

* cited by examiner

*Primary Examiner* — Mary A Davis
*Assistant Examiner* — Dapinder Singh
(74) *Attorney, Agent, or Firm* — Cantor Colburn LLP

(57) ABSTRACT

A vane pump is disclosed that includes a plurality of vanes and radial slots configured to provide a gap between the vane and the radial slot such that the vane has a different angular position relative to the direction of rotation in a radially extended position compared to an angular position in a radially-retracted position. The different angular positions provide different orientation of the arcuate surface of the vane tip portion with respect to the cam body inner surface, thus providing different fluid stop points on the vane tip portion arcuate surface.

14 Claims, 4 Drawing Sheets

VANE PUMP

BACKGROUND

This disclosure relates to vane pumps. Vane pumps include different varieties such as single acting or double acting and can be fixed or variable displacement. This disclosure is applicable to all types of vane pumps.

A typical double-acting vane pump 10 is depicted in FIG. 1. The vane pump includes a plurality of vanes 12 supported in slots in a rotor 14. A shaft 16 supported concentrically within a cam block 18 rotates the rotor in the direction of arrow 20. The vanes 12 have radial portions 15 and tip portions 17, and are driven outward from the rotor into contact or engagement with an inner surface 22 of the cam block 18. During operation, shaft 16 rotates within the cam block 18 to move each of the vanes 12 about the circumference of the inner surface 22 of the cam block 18. The contour of the cam block inner surface 22 creates radial movement of each of the vanes 12, with the vanes 12 moving into and out of the slots in the rotor 14 as they follow the contour of the cam block inner surface 22

As the vanes move through the inlet regions 24, a quantity of fluid is trapped within a fluid flow chamber defined between the vanes 12 in the direction of rotation and between rotor 14 and the cam block inner surface 22 in the direction the radial direction. The volume of this chamber begins at an initial size that is progressively increased as the vane transitions from inlet region 24 to pump arc 26. In the pump arc 26 the vane 12 extends a constant amount from the rotor 14. As the vane 12 transitions from the pump arc 26 to the discharge region 30, the radial distance between the rotor 14 and the cam block inner surface 22 is gradually decreased. The decrease in volume of the fluid flow chamber coincides with removal of fluid from the flow chamber through the pump discharge. The discharge pressure is dependent upon the resistance of the downstream system The vanes rotate through pump arcs 26 where high pressure is exerted on the leading surface of the vane and low pressure is exerted on the trailing surface, and through seal arcs 28 where low pressure is exerted on the leading surface of the vane and high pressure is exerted on the trailing surface of the vane. In the inlet regions 24, inlet fluid pressure is provided to support the vanes so that the vanes are radially pressure balanced. In the discharge regions 30, discharge fluid pressure is provided to support the vanes so that the vanes are also radially pressure balanced in the discharge regions.

In the pump arc and the seal arc, pressure has often been required under the vanes to maintain a seal between the vane tip and the cam block inner surface. Such under-vane pressure can combine with pressure in the fluid flow chamber to result in excess radial pressure load and outward centrifugal force pushing the vane against the cam inner surface. This can result in high adhesive wear stresses between the vane tips and the inner surface of the cam block resulting in damage to the vane and to the cam block. However, prior attempts to remove or reduce under-vane pressurization have often resulted in inadequate outward radial load during low speed operation such as at startup, when centrifugal forces are insufficient to drive the vanes radially outward into engagement with the cam block surface.

U.S. Pat. No. 7,637,724 discloses a vane pump where a vane tip 31 has a radius centered on a centerline offset relative to a leading surface of the vane. This offset provides an imbalance of the fluid pressure forces acting radially on the vane tip to generate a positive contact force that in the pump arc that can supplement the centrifugal force at low operating speeds to reduce or eliminate the need for under-vane pressurization in the pump arc. This is depicted in FIG. 2A, where low (inlet) pressure acts on vane surfaces 32, 33, and 34, and high (discharge) pressure acts on vane surfaces 36, 38, and 40. An offset 41 between a centerline 42 of the radial tip 17 and a leading vane surface 44 provides a surface area differential between surfaces 36 and 40 subject high pressure, such that fluid pressure acting on the larger surface 40 and the smaller surface 36 results in a net outward radial load urging the vane into engagement with the cam block inner surface 22. In the seal arcs 26, however, as depicted in FIG. 2B, the larger surface area 40 under the vane tip 31 is not subjected to fluid pressure with the vane in the retracted position. Low (inlet) pressure acts on surfaces 46 and 48, high (discharge) pressure acts on surfaces 33, 50, and 52, and a gradient of pressure acts on surface 53. In the seal arcs 26, the offset 41 now provides a surface area differential of the surfaces subjected to high pressure, between the larger area of surface 50 and the smaller area of under-vane surface 33, resulting in a net radial load inward when the surfaces are subjected to fluid pressure. This necessitates the provision of additional pressurization under the vane in the seal arc, which adds complexity, cost, and weight, in addition to subjecting the under-vane cavities to pressure pulsations.

BRIEF DESCRIPTION

In some aspects of the disclosure, a vane pump comprises a housing including an inlet and an outlet. A cam block is disposed in the housing, and has a continuous inner surface including a pump arc and a seal arc. A rotor is configured to rotate within the cam block, and includes a plurality of radial slots. A plurality of radially-extendable vanes are disposed in the slots and configured to radially extend from the slots as they rotate past the cam block pump arc. The vanes retract as they rotate past the cam block seal arc. Each of the vanes comprises a radial portion in one of the radial slots and a tip portion extending transverse to the radial portion in a direction of rotation of the rotor. The tip portion has an arcuate surface that engages with the cam block inner surface to provide a fluid seal point along the arcuate surface. Each of the plurality of vanes and radial slots are configured to provide a gap between the vane and the radial slot such that the vane has a different angular position relative to the direction of rotation in a radially extended position compared to an angular position in a radially-retracted position. The different angular positions provide different orientation of the arcuate surface of the vane tip portion with respect to the cam body inner surface, thus providing different fluid stop points on the vane tip portion arcuate surface.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
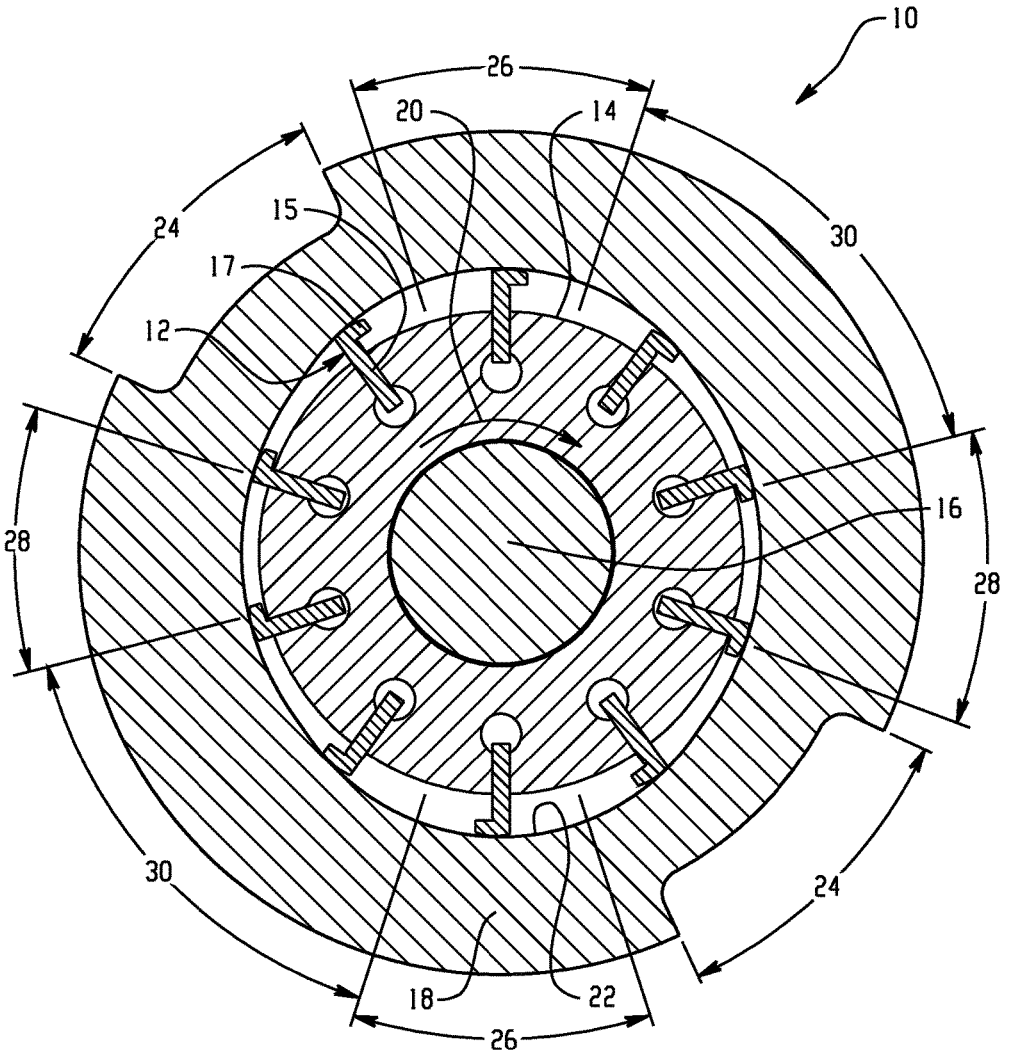
Fig. 1 PRIOR ART
FIG. 1 is a schematic depiction of a typical balancing vane pump.
Figure 2A:
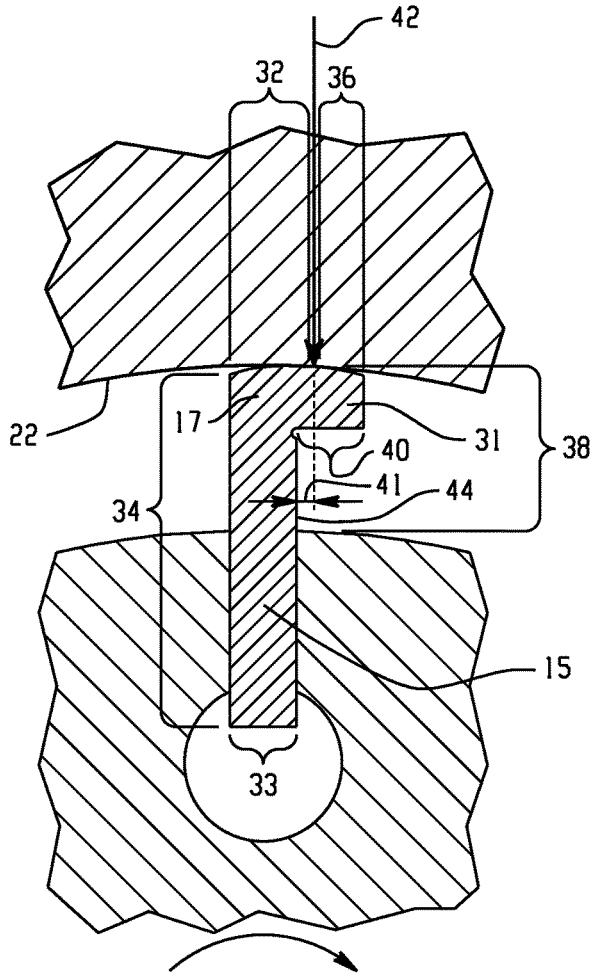
FIGS. 2A and 2B schematically depict a vane configuration having a tip portion offset to enhance the distribution of radial forces on the vanes.
Figure 2B:
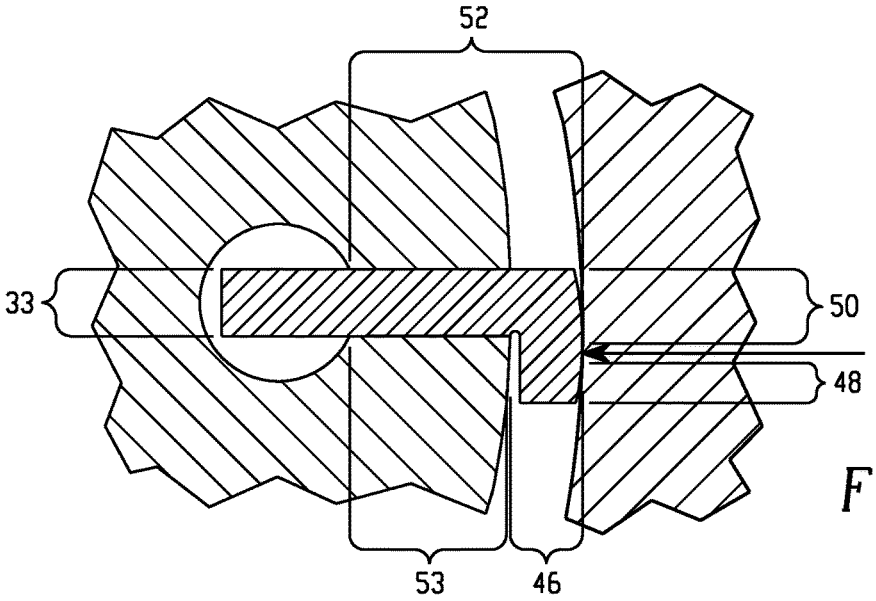
Figure 3A:
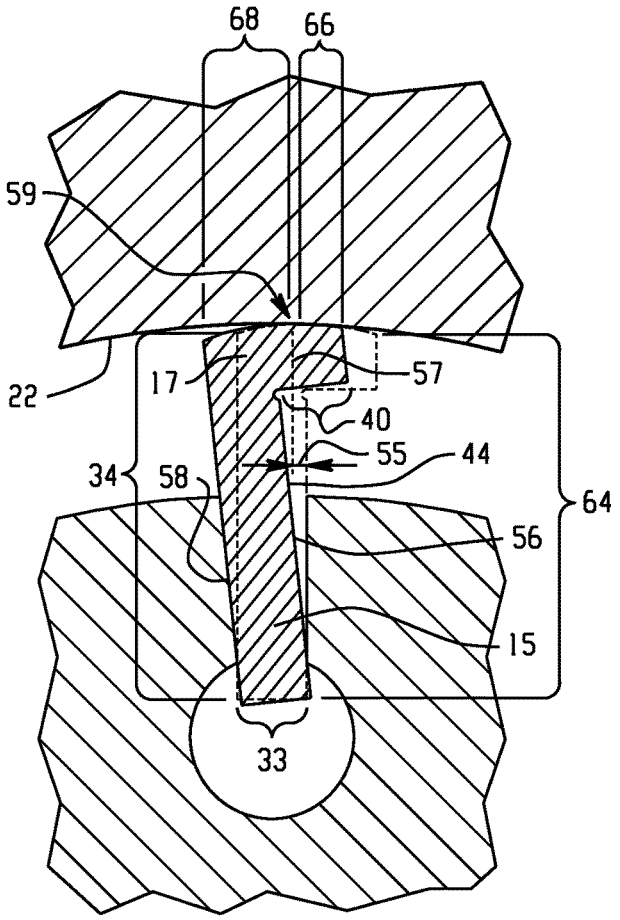
FIGS. 3A and 3B schematically depict a vane configuration.
Figure 3B:
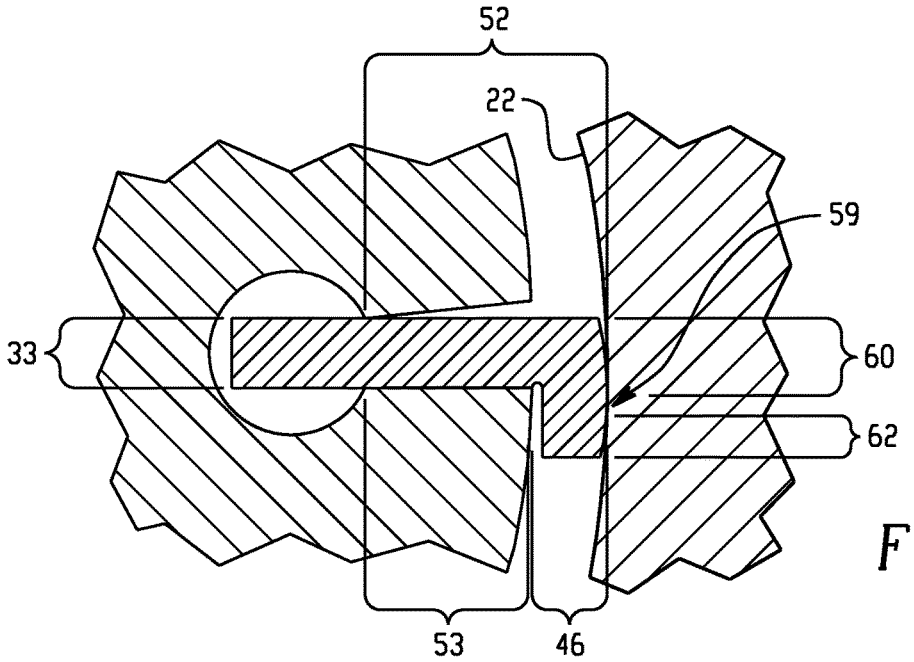

Referring to FIGS. 3A and 3B, a vane configuration is depicted having a gap between the vane and the radial slot as described herein. The vane in FIGS. 3A and 3B differs from that of FIGS. 2A and 2B in that it does not require the FIG. 2 offset 41 to provide outward radial load on the vanes in the pump arcs. FIG. 2 depicts an offset 41 where a centerline 42 of the radial tip 17 is offset from the leading vane surface 44 toward the direction of rotation to provide the pressure and surface area differential for outward radial load in the pump arcs. It should be noted here that the term "centerline" as used herein refers to an imaginary line extending from the center of the arcuate surface of the radial tip to the arc center point (i.e., the center of an imaginary circle of which the vane tip arcuate surface is a part). The vane in FIG. 3 has an offset 55 where the offset from the leading vane surface 44 is away from the direction of rotation instead of toward the direction of rotation. The offset 55 (which can be referred to as a negative offset, with the offset 41 of FIG. 2 referred to as a positive offset) can be configured to provide balanced or biased radial loads during operation in the seal arc as described in more detail below. However, this disclosure can also be used to provide variable seal point configurations for vane designs having different zero offsets, or even with positive offsets such as offset 41 of FIG. 2. The disclosure can also be used to provide variable seal point configurations for straight vanes, as well as for balanced vane configurations such as those depicted in FIGS. 1-4.

As shown in FIG. 3B, during operation in the seal arc, tangential pressure differences provided by high fluid pressure acting on surface 52 urges the vane against the leading slot edge 56 (FIG. 3B). The offset 55 provides a surface area differential between the surfaces 33 and 60 subject to high pressure in the seal arc, where high (discharge) pressure acts on surfaces 33, 52, and 60, low (inlet) pressure acts on surfaces 40, 46 and 62, and a gradient of pressure acts on surface 53. During operation in the seal arc, fluid pressure acting on the larger surface 33 and the smaller surface 60 can result in a net outward radial load urging the vane into engagement with the cam block inner surface 22. As mentioned above, however, a negative offset is not required and embodiments are contemplated where a zero offset is utilized to provide balanced radially-acting pressure, or a positive offset similar to or smaller in magnitude than the positive offset depicted in FIG. 2A.

FIG. 3A depicts the vane in operation in the pump arc. The vane slot is defined by leading slot edge 56 and trailing slot edge 58. The extended vane is shown by a dashed line in a forward position in the slot for illustration and comparison. During operation in the pump arc of the vane pump (FIG. 3B), high (discharge pressure acts on vane surfaces 40, 64, and 66, and low (inlet) pressure acts on surfaces 33, 34, and 68. Tangential pressure differences provided by high fluid pressure acting on surface 64 urges the vane against the trailing slot edge 58 so that the vane moves into the position represented in FIG. 3A by the solid line. This tipping movement of the vane re-positions the point of engagement between the arcuate surface of vane tip 17 and cam body inner surface 22 (i.e., fluid stop point 59) forward (in the direction of rotation) along the arcuate surface of the vane tip compared to a position of the fluid stop point at or near the centerline 57 when the vane is in a forward position in the slot such as during operation in the seal arc (FIG. 3B). This forward repositioning of the fluid stop point on the arcuate surface of the vane tip 17 provides for a relatively smaller surface 66 exposed to high fluid pressure compared to the surface 40. During operation in the pump arc, fluid pressure acting on the larger surface 40 and the smaller surface 66 can result in a net outward radial load urging the vane into engagement with the cam block inner surface 22.

The gap between the radial portion of the vane 15 and the slot in FIGS. 3A and 3B is provided by angling the trailing slot edge 58 away from the direction of rotation. Of course, the configuration represented by FIGS. 3A and 3B is only one example of a configuration that can provide such a gap, and variations can be made to either or both of the slot shape, dimensions, and configuration, and the vane radial portion shape, dimensions, and configuration. For example, FIGS. 3A and 3B depict a trailing slot edge 58 that is at a fixed angle with respect to the leading slot edge 56. However, the angle can be varied depending on radial distance from the axis of rotation, or the gap can be provided by an angled surface on the leading slot edge 58 or on the leading or trailing surfaces of the vane radial portion 15. In some embodiments, a fixed angle between the leading slot edge 56 and the trailing slot edge 58 can vary from 0.1° to 2.0°, depending on the cam profile maximum and minimum radius, so called the vane stroke, and vane tip radius. However, a fixed angle is not required, and the gap between the slot and the vane can be provided by irregular shaped configurations such as step recesses.

The shape and configuration of the arcuate surface of vane tip 17 can be designed based on parameters such as the radius of cam surfaces, length of the radial vane portion 15, length of extension of the vane out of the slot, and angle of rotation of the van within the slot, to control the location of the fluid stop position along the arcuate surface of the vane tip 17 and to provide desired levels of radial load urging the vane 12 into engagement with the cam block inner surface 22. The arcuate surface of the vane tip 17 should be configured to have a greater angle of curvature (e.g., smaller radius of curvature) at the point of engagement with the cam block inner surface, and to provide the desired re-positioning of the point of engagement along the arcuate surface of the vane tip 17 in response to tipping of the vane. The vane and slot can be configured to provide an angular rotational range of the vane of 0.1° to 2.0° in the slot in the extended position, more specifically from 0.3° to 1.5°. The vane and slot can be configured to provide an angular rotational range of 0.1° to 2.0° in the extended position, more specifically from 0.0° to 1.5°.

The capability of angularly re-positioning the vanes of a vane pump at different cycles of the pump's rotation allows for an offset in the direction of rotation between a fluid stop point where the vane engages the cam block inner surface in the pump arc compared to a leading surface of the vane's radial portion, while also allowing for a zero or negative offset in the seal arc, so that a desired level of radial load can be maintained on the vanes throughout the pump's rotational cycle to maintain a desired level of engagement of the vane with the cam block inner surface. This can avoid the need for complex under-vane pressurization schemes to supplement outward centrifugal force that can be insufficient at low pump speeds such as during startup.

Figure 4:
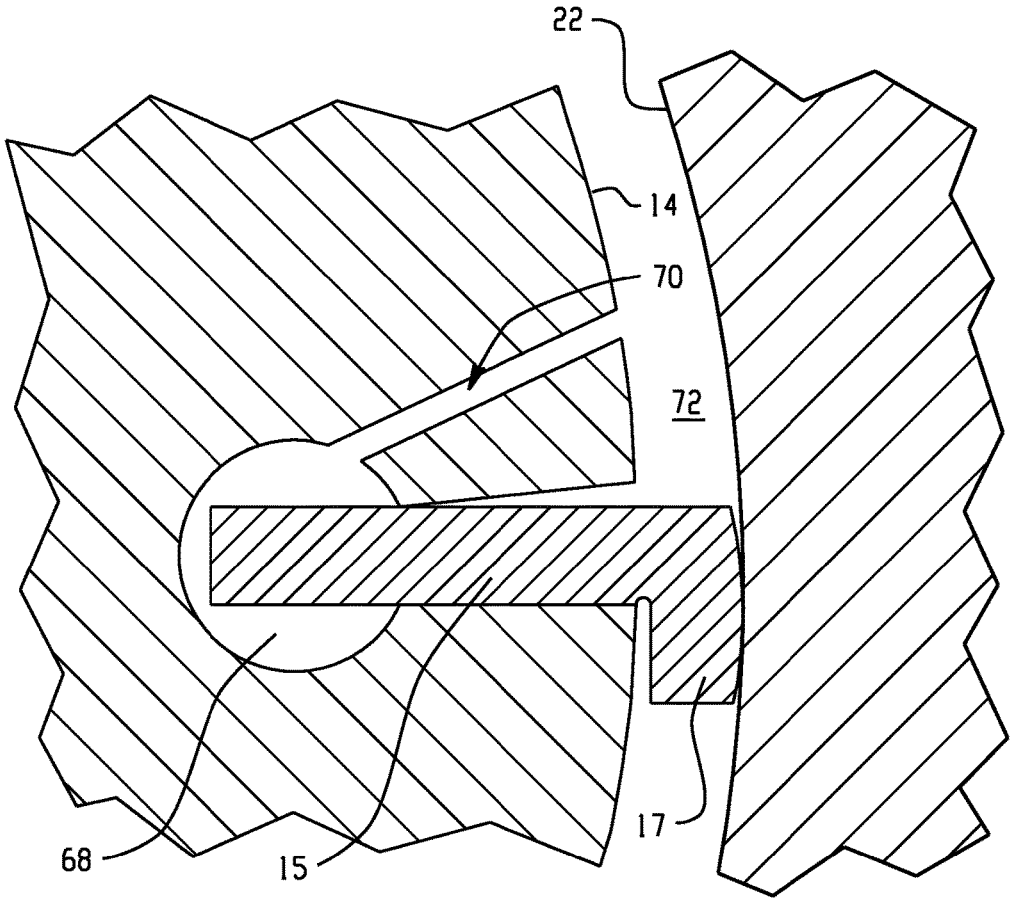
FIG. 4 is a schematic depiction of a vane configuration.

As mentioned above, under-vane pressurization can contribute to under-vane pressure pulsations, which can cause vane tip wear quickly, cavitation, control valve pressure droop, and the avoidance of such under-vane pressurization can help avoid pressure pulsations. Pressure pulsations can be further reduced by a channel to equalize pressure under the vane and the fluid flow chamber area trailing the vane. As shown in FIG. 4, an under-vane chamber 68 is connected by channel 70 to a fluid flow chamber 72 bordered by the surface of the rotor 14, the cam block inner surface 22, and the vane depicted in FIG. 4 and an adjacent trailing vane (not shown). The channel 70 can promote steady under-vane pressure as same as the overvane trailing edge pressure regardless of the vane position in the inlet and discharge ports or in pump arc and the seal arc as shown in FIG. 3A surfaces 33 and 68 or FIG. 3B surfaces 33 and 60.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A vane pump, comprising a housing including an inlet port and an outlet port;

a cam block having a continuous inner surface including a pump arc and a seal arc;

a rotor configured to rotate within the cam block, said rotor including a plurality of radial slots;

a plurality of radially-extendable vanes that radially extend from the slots as they rotate past the cam block pump arc and retract as they rotate past the cam block seal arc, each of the vanes comprising a radial portion in one of the radial slots and a tip portion extending transverse to the radial portion in a direction of rotation of the rotor, said tip portion including an arcuate surface that engages with the cam block inner surface to provide a fluid seal point along the arcuate surface;

wherein the radial slots have a leading edge along a plane coincident with an axis of rotation of the rotor and a trailing edge at an angle with respect to the leading edge, and each of the plurality of vanes and radial slots are configured to provide a gap between the vane and the radial slot such that the vane has a different angular position relative to the direction of rotation in a radially extended position compared to a radially-retracted position, thereby providing different fluid stop points on the vane tip portion arcuate surface.

2. The vane pump of claim 1, wherein the fluid seal point of the vane in the radially extended position is offset in the direction of rotation relative to a leading surface of the vane radial portion.

3. The vane pump of claim 1, wherein the fluid seal point of the vane in the radially retracted position is not offset with respect to the direction of rotation relative to a leading surface of the vane radial portion.

4. The vane pump of claim 1, wherein the fluid seal point of the vane in the radially retracted position is offset away from the direction of rotation relative to a leading surface of the vane radial portion.

5. The vane pump of claim 1, wherein the arcuate surface of the vane tip portion has a center line that is offset in the direction of rotation relative to a leading surface of the vane radial portion.

6. The vane pump of claim 1, wherein the arcuate surface of the vane tip portion has a center line that is not offset with respect to the direction of rotation relative to a leading surface of the vane radial portion.

7. The vane pump of claim 1, wherein the arcuate surface of the vane tip portion has a center line that is away from the direction of rotation relative to a leading surface of the vane radial portion.

8. The vane pump of claim 1, wherein the vane has a rotational angular range of motion in the slot in a fully extended position of 0.1° to 2.0°.

9. The vane pump of claim 1, wherein the gap between the vane and the radial slot is an angular gap having a fixed angle.

10. The vane pump of claim 9, wherein the angular gap has an angle in the direction of rotation of 0.1° to 2°.

11. The vane pump of claim 1, wherein the radial slot trailing edge is disposed at a fixed angle to the leading edge.

12. The vane pump of claim 11, wherein the fixed angle is from 0.1° to 2.0°.

13. The vane pump of claim 1, further comprising a vent connecting a cavity under the vane to a surface of the rotor on a trailing side of the vane.

14. The vane pump of claim 1, wherein the vane pump does not include under-vane pressurization.

* * * * *